US005683631A

United States Patent [19]

Zabreznik

[11] Patent Number: 5,683,631

[45] Date of Patent: Nov. 4, 1997

[54] CARBONACEOUS PACKING MATERIAL FOR PREBAKED ANODE MAUFACTURE IN OPEN PIT RING FURNACES

[76] Inventor: Rodney D. Zabreznik, 1077 Knopp School Rd., Fredericksburg, Tex. 78624

[21] Appl. No.: 526,581

[22] Filed: Sep. 11, 1995

[51] Int. Cl.[6] ..... F27B 21/00

[52] U.S. Cl. ..... 264/57; 264/37; 264/58; 264/105; 264/234

[58] Field of Search ..... 264/37, 57, 58, 264/105, 234

[56] References Cited

U.S. PATENT DOCUMENTS

| | | | |
|---|---|---|---|
| 1,170,313 | 2/1916 | Nagelschmitz | 264/105 |
| 1,456,495 | 5/1923 | Sieurin | 264/105 |
| 1,670,052 | 5/1928 | Soderberg | 264/105 |
| 2,522,766 | 9/1950 | Swallen et al. | 264/105 |
| 2,529,041 | 11/1950 | Muller | 264/105 |
| 3,370,113 | 2/1968 | Goeddel | 264/57 |
| 4,096,097 | 6/1978 | Yan | 264/105 |
| 5,028,370 | 7/1991 | Neuper | 264/105 |

*Primary Examiner*—Donald E. Czaja
*Assistant Examiner*—Michael P. Colaianni

[57] ABSTRACT

An improved method is provided for the production of heat-treated carbon bodies in open-pit, ring furnaces. In the improved process green carbon bodies are packed with a carbonaceous particulate packing material containing as a constituent green petroleum coke in a blend with calcined and/or recycled petroleum coke particles. Utilization of green petroleum coke, used primarily to replenish oxidized packing material in the ring furnace, results in significant energy and process cost savings. In the event the green petroleum coke is green delayed petroleum coke, the balance of the packing material is selected from calcined delayed petroleum coke, recycled packing material containing heat-treated delayed petroleum coke and/or mixtures of these; if the green petroleum coke used in the blend is green fluid petroleum coke, then the balance of the packing material is heat-treated calcined fluid coke. Low grade green delayed petroleum coke is allowed to be used in the packing material.

12 Claims, 3 Drawing Sheets

EXAMPLE OF A TYPICAL OPEN-PIT, RING BAKING FURNACE

INDIVIDUAL BAKING PIT
OF AN OPEN-PIT RING FURNACE

LONGITUDINAL CROSS-SECTION OF FULLY PACKED ANODE BAKING PIT

TRANSVERSE CROSS-SECTION OF FULLY PACKED ANODE BAKING PIT

CARBONACEOUS PACKING MATERIAL FOR PREBAKED ANODE MAUFACTURE IN OPEN PIT RING FURNACES

BACKGROUND OF THE INVENTION

In many industrial processes carbon bodies are utilized, for example, as electrodes. A typical case is the electrolytic production of metals, such as the production of primary aluminum, wherein alumina is electrolytically reduced using, in most instances, prebaked carbon electrodes. These prebaked carbon anodes are usually manufactured at the metal production facility in auxiliary facilities associated with the metal production itself. The manufacture of the prebaked carbon anodes generally proceeds by mixing crushed, calcined delayed petroleum coke, or in some instances, calcined fluid petroleum coke or calcined pitch coke, with remnants of earlier manufactured prebaked anodes and a binder, such as coal tar pitch, followed by shaping the green mixture into blocks and baking of the blocks to about 1150° C. Among other things, baking removes volatile matter and improves the electrical conductivity of the anodes. World-wide, up to about seventy percent of all aluminum smelters employ prebaked anodes in the electrolytic reduction process and about seventy percent of these utilize open-pit, ring baking furnaces for the manufacture of their anodes. The smelters, which use open-pit ring furnaces for anode baking, account for about 8,000,000 metric tons of annual primary aluminum production and these smelters customarily heat-treat their green carbon anodes by placing the anode blocks in the ring furnace where these blocks are surrounded with either calcined delayed coke or calcined fluid petroleum coke, followed by heating of the furnace to obtain the prebaked anodes. Packing around the blocks with petroleum coke is required in order to support the anodes to prevent deformation and restrict oxidation while baking. The coke used for packing is generally recycled within the ring furnace for use in subsequent baking cycles. However, for each metric ton of anodes baked, about 5 to 40 kilograms of packing material is consumed in the baking process and must be replenished to achieve the above-stated purposes.

The calcined petroleum coke, either the delayed or the fluid type, which is used as packing material in the ring furnace, must be purchased by the smelter from calcined coke manufacturers, who produce the calcined petroleum coke from green petroleum coke supplied by oil refineries. Green petroleum coke is produced by the refineries as part of the petroleum refining process and is routinely sold by them to calcined coke manufacturers for further processing and ultimate sale to industrial consumers, such as aluminum smelters. At the aluminum smelters, the calcined coke is used both as an anode constituent and as the packing agent in the ring furnace.

When prebaked carbon anodes are produced in open-pit, ring furnaces and where the packing material utilized is either type of calcined coke, such coke undergoes multiple heat treatment processes, the first one involving its original manufacture from green coke by calcination, the latter ones are associated with the cyclical manufacture of prebaked carbon anodes.

Calcination of green petroleum coke, whether used for making of calcined delayed petroleum coke or calcined fluid petroleum coke, entails significant energy usage.

It has now been discovered that in order to eliminate the various costs associated with coke calcining and to reduce the significant energy usage involved in the heat treatment steps described above, and also to obtain considerable savings in the coke calciner volatile treatment steps, the packing material utilized in the manufacture of prebaked anodes in open-pit, ring furnaces can entail the use of green (uncalcined) delayed petroleum coke or green fluid petroleum coke. According to the present invention, either type of green petroleum coke may be substituted for calcined petroleum coke to correspondingly replenish the packing material regularly consumed in the open pits during the baking of the anodes. The green coke used in accordance with the invention can be either blended with the corresponding type of used calcined delayed petroleum coke or calcined fluid petroleum coke, which used cokes have been recovered from the ring furnace where they were employed as packing materials, or with the corresponding types of unused calcined petroleum cokes. Mixtures of the corresponding types of used and fresh calcined cokes can also be used in combination with the green coke utilized.

Additionally, the green petroleum coke employed in the packing material can be advantageously of a lower quality than typical electrode-grade calcined petroleum coke. However, the lower quality green petroleum coke may only be used in the packing material.

BRIEF SUMMARY OF THE INVENTION

An improved method is provided for making prebaked carbon anodes in open-pit, ring furnaces. The method involves the preparation of green carbon anode blocks in the conventional manner, positioning the anode blocks in an open-pit, ring furnace; surrounding the anode blocks with particles of a carbonaceous material, the carbonaceous packing material being selected from a mixture of green petroleum coke (GPC) and calcined petroleum coke (CPC), or GPC and recycled calcined petroleum coke (RPC), or a mixture of GPC with both calcined petroleum coke (CPC) and RPC; and subjecting the anode blocks to a heat-treatment. The carbonaceous packing material may be utilized in the ring furnace as a blend of GPC and CPC and/or RPC, or these individual packing materials may be placed in the ring furnace around the green anodes not as a blend but so that the total packing material utilized includes GPC and CPC and/or RPC. A major purpose of the improved method is to allow the prebaked anode producer to replenish his packing material inventory in the baking pits through the intermittent use of green petroleum coke rather than the calcined petroleum coke. The total quantity of green petroleum coke used from time to time in the packing material can be selected within a broad range. Depending on the characteristics of a particular baking furnace and the user's needs from about 1% to about 70% of the aforesaid blend can be green petroleum coke. The heat-treatment of the green anode blocks, with packing materials containing GPC, is generally accomplished at temperatures averaging about 1150° C.

DETAILED DESCRIPTION OF THE INVENTION

Figure 1:
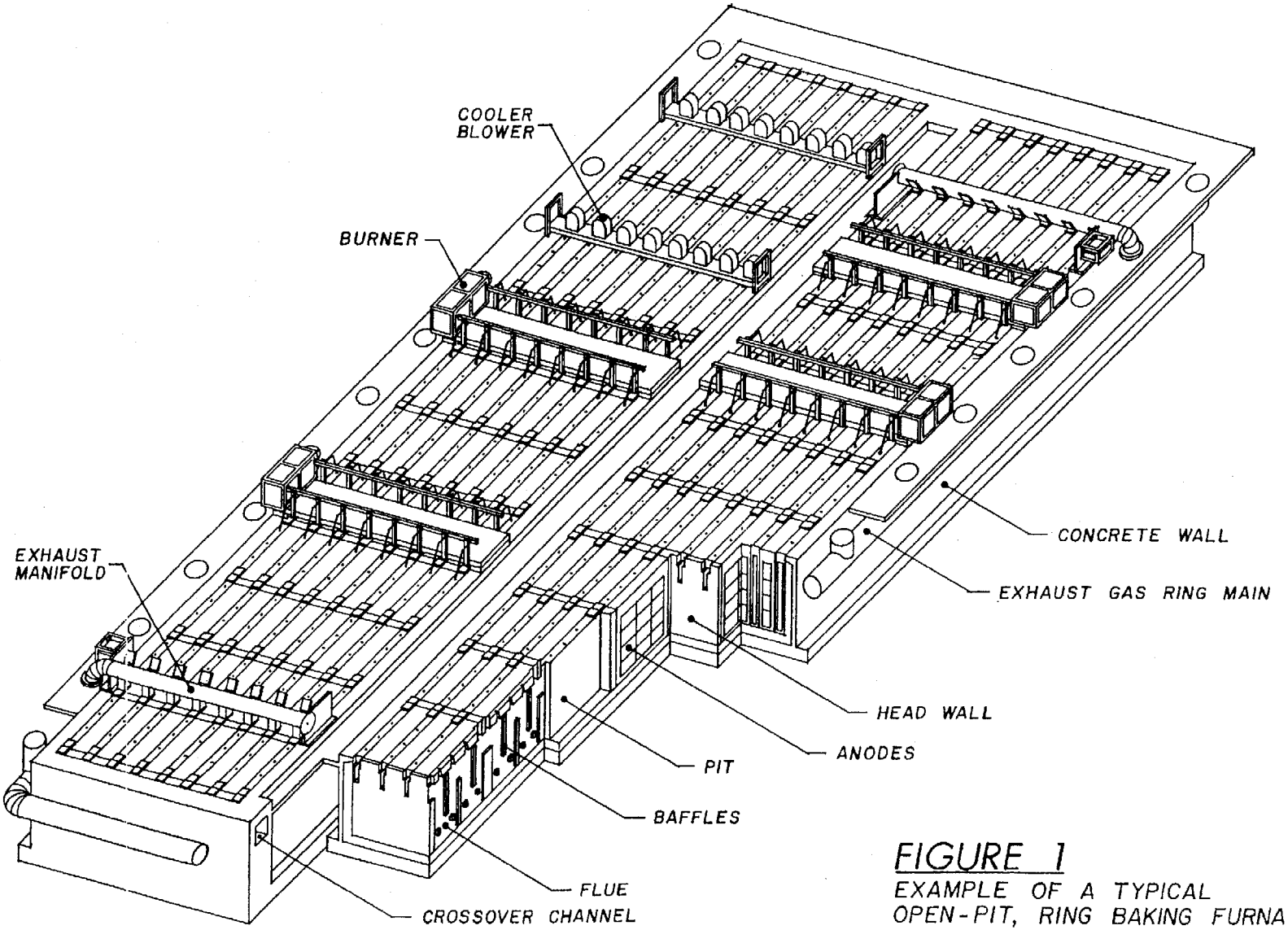
FIG. 1 shows the schematic view of a typical open-pit ring furnace.

This invention relates to a method for the manufacture of heat-treated carbon bodies. More particularly, this invention relates to an improved method for the manufacture of heat-treated carbon bodies in open-pit, ring furnaces.

For ready understanding of the invention, the improved method will be described in detail with respect to the manufacture of prebaked carbon electrodes for use in the electrolytic production of metals, and more specifically, the manufacture of carbon anodes for the electrolytic production of primary aluminum. Notwithstanding the foregoing, the method of the present invention is capable of producing heat-treated carbon bodies, including graphite electrodes, which can be utilized in industries other than those engaged in the electrolytic production or smelting of metals.

For the purposes of the invention, the following terms, referred to hereinafter in the specification, shall have the following meanings assigned thereto:

(a) the terms "green petroleum coke", "green fluid petroleum coke", or "green delayed coke", collectively "GPC" shall refer to an uncalcined carbonaceous particulate material produced during the petroleum refining process by the application of certain cracking conditions.

(b) "calcined petroleum coke" or "CPC" shall mean a particulate carbonaceous product which has been produced from green petroleum coke by calcining the green petroleum coke in a calcining facility at temperatures in excess of about 1100° C., generally within the range of 1150°–1350° C.;

(c) "recycled petroleum coke", or "used petroleum coke", or "RPC" means a particulate carbonaceous product which has previously been used in the open-pit, ring furnace as packing material for the green carbon bodies to be baked. The RPC can be derived from calcined delayed petroleum coke, calcined fluid petroleum coke, or green petroleum coke, which GPC has previously undergone baking in the open-pit ring furnace while it has been used as part of the packing material. Under normal operating conditions, the packing agent utilized in the ring furnace, contains either delayed coke derived packing material or fluid coke derived packing material but not a mixture of these two different types of cokes;

(d) "green anode" or "green anodes" mean anode blocks to be subjected to baking in an open-pit, ring furnace while surrounded with a carbonaceous, particulate packing material;

(e) "volatiles" mean volatile and combustible vapors evolved from either the green anodes or from GPC, for example, hydrogen, water, carbon oxides and other compounds, as may be determined by standard laboratory methods;

(f) "baked" anodes mean those green anodes which have undergone a heat-treatment in an open-pit ring furnace according to the method of the invention; and (g) "butts" mean the residues or remnants of baked anodes recovered from the electrolytic aluminum reduction process.

In the illustrative method of the present invention, the baked anodes to be used by aluminum smelters in the electrolytic production of primary aluminum are generally produced from a carbonaceous mixture. While most aluminum smelters have their own proprietary carbonaceous compositions used for the manufacture of prebaked anodes, generally these carbonaceous mixtures contain calcined delayed petroleum coke (CDC) and butts and a carbon-containing binder. Certain aluminum smelters are known to utilize alternative carbon materials in their anode production, including calcined fluid petroleum coke and calcined coal tar pitch coke, as well as CDC. Regardless of the differing anode mass compositions, the novel baking method of the invention may be applied to all of the existing anode masses.

Typically, in the manufacture of the anodes, the CDC and butts are sized to the desired particle size distribution, then this sized material is mixed with the binder, such as coal tar pitch or other suitable binders. The resulting mixture is then shaped to obtain the desired form and size, typically a block-like object. Shaping may be accomplished by pressing or vibrating the putty-like mass to form a green anode. The green anode block is then subjected to a baking step primarily to remove substantially all volatile materials from it and to render it more electrically conductive.

In the event the baking is accomplished in the open pit of a ring furnace, such as shown in FIG. 1, then the pit is charged with one or more green anodes and then these green anodes are surrounded, or packed, with the carbonaceous packing material in a manner to obtain a supportive, oxidation-resistant covering around the outer surfaces of the green anodes. Dependent on the furnace design and the GPC content of the blend used for packing, a leveling layer of either RPC, CPC or a blend may be used between the pit bottom and the first anode block layer. In the event agglomeration is experienced in this leveling layer during baking, then in future leveling layers the blend ratio of GPC to RPC and/or CPC should be reduced.

Figure 2:
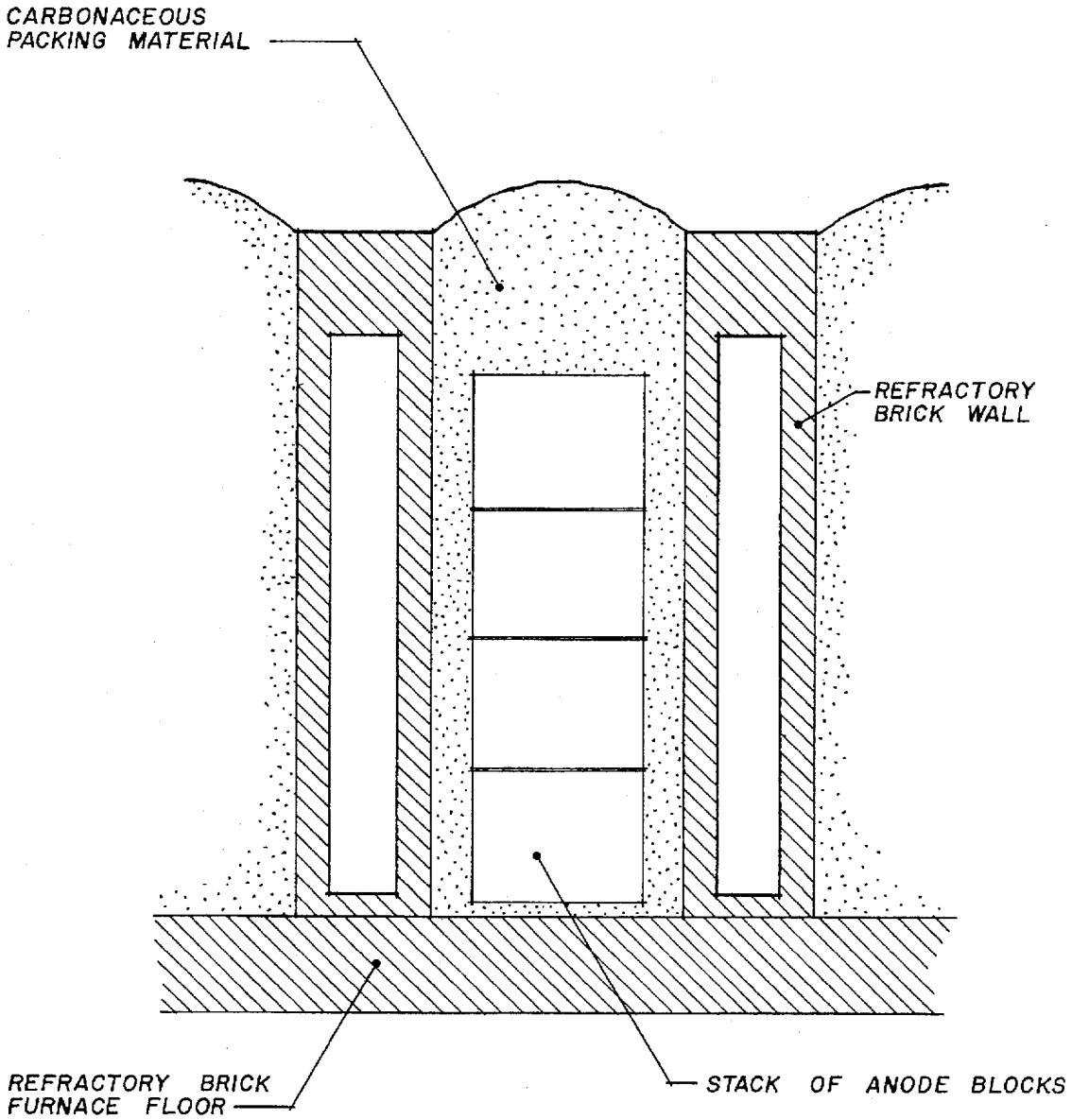
FIG. 2 shows a transverse cross-sectional view of an individual baking pit and two adjacent flues of an open-pit ring furnace containing the green anode blocks to be baked surrounded by carbonaceous packing material.

An example of surrounding the green anodes with the packing agent is shown in FIG. 2. The main reason for surrounding the outer surfaces of the green anodes with the carbonaceous packing material or agent is to prevent oxidation and distortion or warping of the green anodes but at the same time to provide a permeable avenue of escape for the volatilized compounds of the binder. These purposes are readily achieved by the method of the invention and at the same time significant energy saving is also realized through the use of green coke rather than calcined coke as a major constituent in the packing material. These aims could not be obtained through the use of the prior art open-pit, ring furnace anode baking method employing calcined petroleum coke.

In the method of the invention, the packing material inventory in the pit is to be replenished from time to time and the replenishing agent contains a significant quantity of green petroleum coke or GPC, the balance being selected from calcined petroleum coke, recycled calcined coke, or mixtures of these.

For best results, in order to obtain the advantages described above, the GPC may be utilized to a level up to about 70%, this percentage being based on the total weight of the blend of packing material utilized in the baking of the green anodes. To obtain the optimal process efficiency and the claimed economic advantages, it is preferred that the quantity of GPC utilized in the method of the invention be maintained in the range of about 10% to about 60%, these percentages also being based on the weight of any GPC-containing blend employed as packing material in the green anode baking step.

Figure 3A:
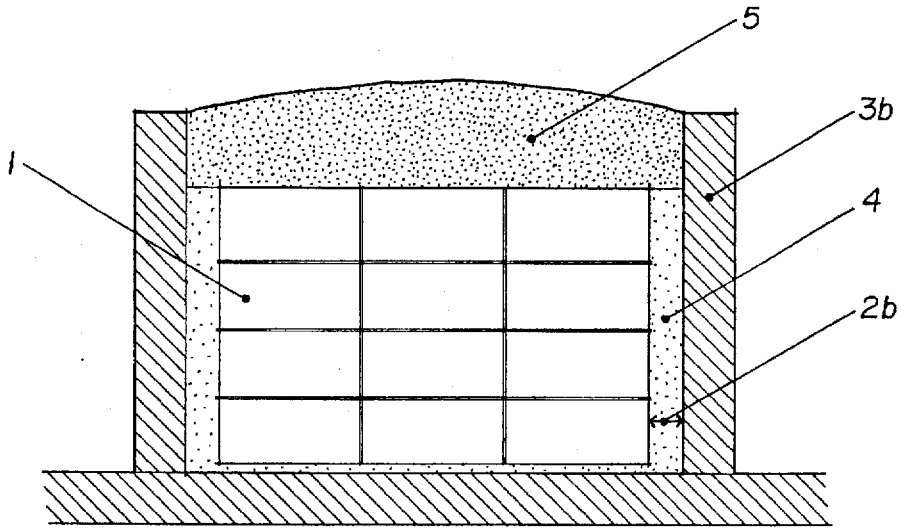
FIG. 3(*a*) shows the longitudinal cross-section of a fully packed baking pit, whereas FIG. 3(*b*) shows the transverse cross-section of a fully-packed baking pit. In both instances a blend of packing material surrounds the lateral surfaces of the green anode blocks while the top surfaces of the blocks are covered by recycled calcined petroleum coke.
Figure 3B:
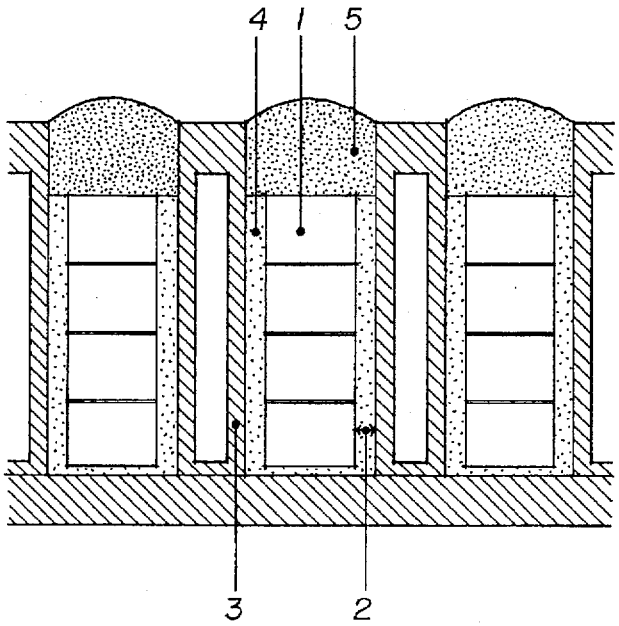

The GPC is utilized by blending it with the other packing materials described hereinbefore. FIG. 3 shows the use of a blend containing GPC with other packing materials around the lateral faces of the green anode, while the top surface of the green anode is covered with a thick layer of calcined petroleum coke, recycled calcined coke or a mixture of these, without any GPC.

The optimum quantity of GPC to be used in the blend is best established experimentally. The quantity utilized is largely influenced by the design and operating characteristics of the ring furnace, such as the draft in the furnace and the pitch content of the green anode. If the blend tends to agglomerate or stick to the anodes during the baking of the green anodes, or if anodes crack or distort significantly during baking, the level of GPC usage should be downwardly adjusted for subsequent applications of the blend.

Notwithstanding the foregoing, the rate at which GPC can be utilized in most open-pit, ring furnaces and with most green anodes is up to about 70%, preferably within 10–60% by weight of the blend.

In the preferred embodiment of the method of the invention, the blend of GPC and RPC or fresh calcined petroleum coke, is packed around the green anodes to a maximum height corresponding to approximately the top of the uppermost layer of the green anode stack to be baked. This arrangement is shown in FIG. 3. By maintaining the blend surface at or near the top surface of the green anodes to be heat-treated, sufficient calcination and full removal of the hydrocarbon volatile content of the green petroleum coke content of the blend can be assured. In the preferred embodiment described above, the top surface of the top layer of green anodes is generally covered by either RPC, CPC or a mixture of these, taking into account that if CPC used in the packing is calcined fluid petroleum coke, then the RPC employed should have also been derived from CFC. Conversely, if the CPC is calcined delayed coke, then any RPC utilized in the packing should also be derived from CDC.

In those open pit ring furnaces which use calcined delayed petroleum coke as packing material, the packing material utilized is commonly the same type of coke used to fabricate the green carbon bodies themselves. Such calcined delayed petroleum coke is characterized by two major factors, (a) a vanadium content which is generally less than about 400 ppm and (b) a sponge-like macroporosity. Due to these characteristics the calcined delayed coke is considered "high grade". Delayed petroleum coke with a vanadium content in excess of about 400 ppm and/or having a macroporosity resembling those of spheres is considered "low grade". The low grade coke is seldom used as a filler material to make green carbon bodies, as the resultant prebaked carbon body exhibits an increased tendency to oxidize and/or crack at elevated temperatures. Consequently, manufacturers of carbon bodies have historically avoided the use of low grade coke as filler material in making green carbon bodies. Further, they have neither applied low grade delayed petroleum coke as open pit furnace packing material. The method of the invention allows the use of low grade green delayed petroleum coke to be used in the packing material blend, thereby providing additional advantages to the user.

When the packing of the green anode blocks is completed with the proper placement of the blend and other carbonaceous packing material around the anodes, the anodes are subjected to the baking process. The ring furnace is operated so that the temperatures of the two fluewalls directly adjacent to a specific pit are elevated, over a number of days, from room temperature to an average temperature of about 1200° C. to 1400° C. Heat is conducted from the flue walls through the packing material and into the green anode blocks thereby gradually raising the packing material and anode block temperatures over a time period, usually longer than one week, from ambient temperature to a desired target temperature. The target temperature is generally within the range from about 1100° C. to 1200° C. and is measured at a representative point in the pit.

The green anode and GPC volatiles generated during baking generally move laterally through the GPC blend to the fluewall, penetrate the fluewalls through pores and cracks in the refractory and are then burned and/or exhausted.

In the pits of the ring furnace, the maximum temperature to which individual anodes rise varies depending on the specific locations of the anodes within the pit. The temperature distribution of the anodes and the packing material within a typical pit is part of the knowledge of the furnace operators. In most cases, the furnace is designed and operated so that all anodes in a typical pit are raised to at least 1050° C. and the mean anode temperature is from about 1100° C. to 1200° C. Since substantially all of the volatiles are removed from the GPC at temperatures between 250° C. and 1000° C., wherever the GPC-containing blend is used in the baking pit, virtually complete removal of GPC volatiles is accomplished in the normal anode baking cycle where the minimum temperature of the pit is about 1050° C. At this temperature, adequate heat-treatment of the GPC blend is achieved and the heat-treated GPC can subsequently be applied interchangeably with a similar type of RPC or CPC. Thus, the inventive method eliminates the need and associated costs for commercially calcining GPC for use in open-pit, ring baking furnaces as green anode packing material. Also, since in the method of the invention a low grade GPC may be utilized in the packing material, it inherently provides a reduced material cost basis.

Further, the burning of GPC hydrocarbon volatiles, which are generated in the pit and escape through the fluewalls along with volatiles from the green anodes, requires the downward adjustment of the fuel input required for baking the green anodes. Thus, significant energy savings can also be realized by the application of the method of the present invention.

The time required for baking the green anodes in conventional open-pit, ring furnaces, generally depends on the design of the ring furnace, for example its size and the flue arrangement, as well as on the mass of green anodes to be baked. The length of time required for baking anodes in the method of the invention, employing GPC in the packing material, is about the same as the time required in the conventional, prior art green anode baking using open-pit, ring furnaces.

In the following example further details of the method of the invention are provided.

EXAMPLE

In an open-pit, refractory brick-lined, ring furnace of the type shown in FIG. 1 and having multiple individual pits, prebaked anodes were produced for use in the electrolytic aluminum smelting process. For facilitating the understanding of the method of the invention, the baking of the green anodes according to the invention will be described with respect to the baking of green anodes in one of the individual pits of the open-pit, ring furnace, such as is shown in FIG. 3.

Conventional green anodes, made by shaping a carbonaceous green anode mixture containing ground CDC, butts and a sufficient quantity of pitch binder, were produced.

Each of these anodes had the approximate size of 20 inches height, 26 inches width and 42 inches length. Eighteen of the green anodes were placed in the pit to form anode stack 1, as is shown in FIGS. 3 (*a*) and (*b*). As indicated in FIG. 3(*b*), sufficient space 2 was provided around the outer surfaces of the stacked anodes to allow the application of a particulate, carbonaceous packing material between the vertical refractory brick flue walls 3 of the pit and the stacked anodes 1. A blend 4 of particulate packing material, containing an approximate 50:50 by weight mixture of GPC and RPC, was then prepared and this blend 4 was introduced into space 2 provided between vertical refractory brick flue walls 4 and the anode stack 1. Packing was accomplished in such a manner as to provide a dense layer between the walls and the anode stack. The width of space 2 between the vertical refractory brick flue walls 3 and the green anode stack 1 was about 4 inches. With respect to FIG. 3(*a*), the width of space 2*b* between the vertical refractory brick head wall 3*b* and the green anode stack 1 was about 8 inches. Blend 4 was applied to such a height in the pit until it was approximately level with the top horizontal surface of anode stack 1 without covering the top horizontal surface of anode stack 1.

RPC, as shown by reference numeral 5, was then placed on the top of anode stack 1 and also on the top surfaces of blend 4. After placing anode stacks 1 in all of the adjacent pits of this particular section of the ring furnace and completion of the packing of all spaces 2 and 2*b* around anode stacks 1, followed by covering the anode stacks 1 and blend 4 with RPC 5, the baking process of the anodes commenced. The representative temperature of the pit was slowly elevated to about 1100° C. and the baking process was complete after about seven days. Subsequently, the section of baking pits was cooled and the RPC 5, blend 4 and the prebaked anodes were then removed from the pits.

The prebaked anodes were tested and no abnormalities were observed in either the physical properties or in the performance of the anodes. The blend 4, utilized as packing material in the baking process, acted like the conventionally used RPC or CPC and during the baking step, the GPC content of blend 4 had been substantially freed of its volatile content and the material had been successfully converted to a carbonaceous agent ready to be used as RPC in future baking operations.

It is to be understood that the composition and types of the blends used in the method of the invention as packing materials can be varied within wide limits and the above example is considered as illustrative only without intending to limit the scope of the invention to the specific conditions described. The extent and scope of the present invention shall only be limited by the scope of the appended claims.

What is claimed is:

1. In the method of producing heat-treated carbon bodies in open-pit, ring furnaces by subjecting green packed carbon bodies to a heat treatment while such carbon bodies are surrounded with a carbonaceous, calcined particulate packing material, the improvement which comprises: (a) employing as packing material for the green carbon bodies a particulate carbonaceous blend, the blend containing, in addition to a previously calcined packing material, green petroleum coke in an amount between about 1 and 70% by weight of the blend; (b) subjecting the packed green carbon bodies to a heat treatment at a predetermined temperature and for a time sufficient to obtain carbon bodies of improved electrical properties and to achieve conversion of the green petroleum coke content of the packing material and; recovering the heat-treated carbon bodies and a packing material blend having its green petroleum coke content converted to a recyclable heat-treated packing material.

2. A method according to claim 1, wherein the quantity of green petroleum coke in the blend is within the range from about 10% to about 60% by weight of the packing material blend.

3. A method according to claim 1, wherein the green petroleum coke in the blend is green delayed coke and the balance of the packing material is selected from the group consisting of calcined delayed coke, recycled calcined delayed petroleum coke packing material (or) and mixtures of these.

4. A method according to claim 1, wherein the green petroleum coke in the blend is green fluid coke and the balance of the packing material is selected from the group consisting of calcined fluid petroleum coke, recycled calcined fluid petroleum coke (or) and mixtures of these.

5. A method according to claim 1, wherein the heat treatment of the green carbon bodies and the blend used for packing the same, is undertaken at temperatures within the range from about 1100° C. to 1200° C.

6. A method according to claim 1, wherein the blend, utilized for packing the green carbon bodies, contains green delayed petroleum coke and the blend is applied only around the lateral, outside surfaces of the green carbon bodies, the top surface of the green carbon bodies is being covered to a predetermined height with a calcined packing material selected from the group consisting of calcined delayed petroleum coke, recycled calcined delayed petroleum coke (or) and mixtures of these.

7. A method according to claim 1, wherein the blend, utilized for packing the green carbon bodies, contains green fluid petroleum coke and the blend is applied only around the lateral, outside surfaces of the green carbon bodies, the top surface of the green carbon bodies is being covered to a predetermined height with a calcined packing material selected from the group consisting of calcined fluid petroleum coke, recycled packing material (or) and mixtures of these.

8. A method according to claim 1, wherein the green petroleum coke-containing packing material blend is recycled as a packing material after the heat-treatment used for the conversion of the green carbon bodies and the green petroleum coke content.

9. A method according to claim 1, wherein low grade green delayed petroleum coke is utilized in the packing.

10. A method according to claim 1 wherein high grade green delayed petroleum coke is utilized in the packing.

11. A method according to claim 9, wherein the green carbon bodies subjected to the heat treatment are electrodes and these electrodes are employed in the smelting of metals.

12. A method according to claim 9, wherein the green carbon bodies subjected to the heat treatment are used for the electrolytic production of metallic aluminum.

* * * * *